United States Patent [19]

Mizuno et al.

[11] Patent Number: 5,010,349

[45] Date of Patent: Apr. 23, 1991

[54] PLANE PATCH ANTENNA

[75] Inventors: Tsuyoshi Mizuno, Yokosuka; Motoki Hirano, Yokohama, both of Japan

[73] Assignee: Nissan Motor Company, Ltd., Yokohama, Japan

[21] Appl. No.: 494,343

[22] Filed: Mar. 16, 1990

[30] Foreign Application Priority Data

Apr. 12, 1989 [JP] Japan ..... 1-90681

[51] Int. Cl.[5] ..... H01Q 1/36

[52] U.S. Cl. ..... 343/700 MS; 343/830

[58] Field of Search ..... 343/700 MS, 829, 830, 343/846, 848

[56] References Cited

U.S. PATENT DOCUMENTS 2,659,003 11/1953 Dorne et al. ..... 343/780

4,819,003 4/1989 Goto et al. ..... 343/770

FOREIGN PATENT DOCUMENTS 189704 8/1986 Japan .

*Primary Examiner*—Michael C. Wimer

*Attorney, Agent, or Firm*—Pennie & Edmonds

[57] ABSTRACT

A plane patch antenna including patch and earth conductive plate members maintained in spaced-parallel relation to each other. A feeder shaft extends from the patch plate member for electrical connection of the patch plate member to a lead wire. The feeder shaft has a tapered portion extending from the patch plate member toward the earth plate member. The tapered portion has a cross-sectional area decreasing as going away from the patch plate member.

6 Claims, 5 Drawing Sheets

PLANE PATCH ANTENNA

BACKGROUND OF THE INVENTION

This invention relates to a plane patch antenna having two conductive plates maintained in spaced-parallel relation to each other.

For example, Japanese Patent Kokai No. 59-200503 and 59-207705 disclose plane patch antennas having two metal disc plates maintained in spaced-parallel relation to each other by means of a plurality of metal pins. With such a prior art plane antenna, however, its usefulness is limited in land mobile radiotelephone applications, particularly where it is used in the rain. This is stemmed from the fact that the prior art plane patch antenna has an available frequency band width which is too narrow to absorb variations in its frequency characteristic which may occur in the rain.

SUMMARY OF THE INVENTION

Therefore, it is a main object of the invention to provide an improved plane patch antenna having an increased available frequency band width.

There is provided, in accordance with the invention, a plane patch antenna comprising a patch conductive plate member, an earth conductive plate member, a plurality of short pins extending between the patch and earth plate members to maintain the patch and earth plate members in spaced-parallel relation to each other and to make electric connection between the patch and earth plate members, and a feeder shaft extending from the patch plate member for electrical connection of the patch plate member to a lead wire. The feeder shaft has a tapered portion extending a length from the patch plate member toward the earth plate member. The tapered portion has a cross-sectional area decreasing as going away from the patch plate member.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
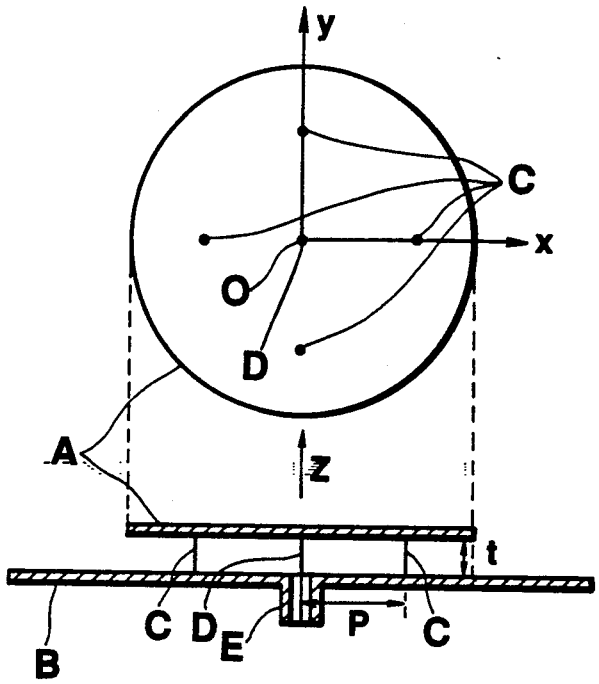
FIG.1 (PRIOR ART)
FIG. 1 is a sectional view of a prior art plane patch antenna.

Prior to the description of the preferred embodiment of the present invention, the prior art plane patch antenna of FIG. 1 is briefly described in order to specifically point out the difficulties attendant thereon.

The prior art plane patch antenna comprises a disc-shaped patch plate member A and a disc-shaped earth plate member B having a diameter greater than that of the patch plate member A. These plate members A and B are made of a conductive material and rigidly maintained coaxially in spaced-parallel relation to each other by a plurality of short pins C secured thereto. The short pins C are conductive pins for providing an electrical connection between the plate members A and B. A feeder shaft D extends from the center O of the patch plate member A through a through-hole E formed centrally in the earth plate member B. The feeder shaft D is taken in the form of a coaxial cable having center threads covered by a braided sheath. The braided sheath is connected to the earth plate member B and the center threads are connected to a lead wire associated with the plate patch antenna. In FIG. 1, the character (p) indicates the distance at which the short pins C are spaced from the feed shaft D and the character (t) indicates the distance between the patch and earth plates A and B.

However, such a prior art patch antenna has an available frequency band width which is too narrow to absorb variances in its frequency characteristic resulting from antenna manufacturing and mounting tolerances and other factors including waterdrops deposited on the plane patch antenna. For this reason, the prior art patch antenna cannot be used in the rain with its most efficiency. In addition, the antenna manufacturing and mounting tolerances are of critical importance.

Figure 2:
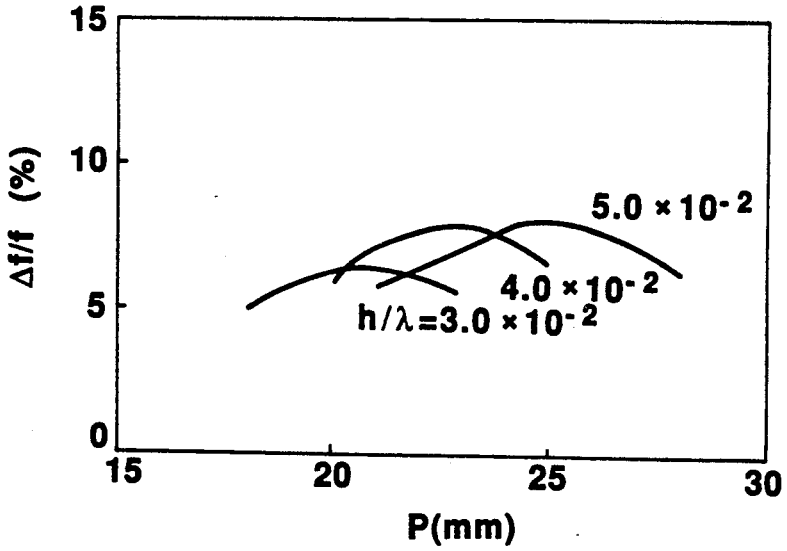
FIG. 2 is a graph plotting fraction band width (Δf/fo) with respect to given distances (p) between the short pins and the feeder shaft.
Figure 3:
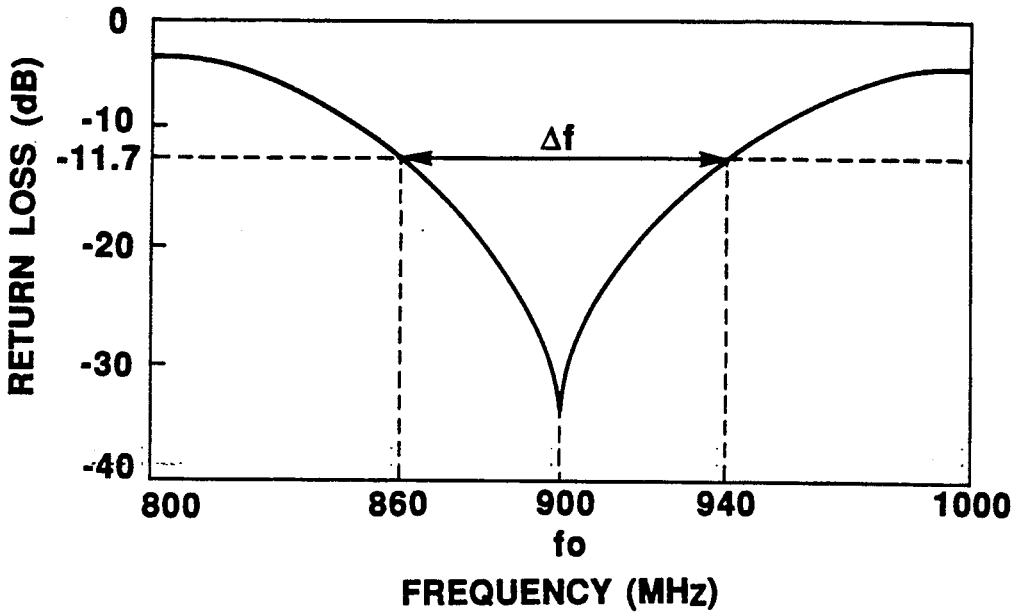
FIG. 3 is a graph used in explaining the available frequency band width of the prior art plane patch antenna at a return loss of −11.7 dB.

FIG. 2 is a graph plotting fractional band width (Δf/fo) with respect to given distances (p) between the short pins C and the feeder shaft D for a return loss of −10 dB. As will be observed from FIG. 2, the fractional band width of the prior art patch antenna is 10% at the most even at a return loss of −10 dB. Where the patch antenna is used for a land mobile radiotelephone, however, the Japanese telegram and telephone standards (VSWR1.7) require a fractional band width of 8% to 10% at a return loss of −11.7 dB, as shown in FIG. 3. The term "fractional band width" means the ratio of the available frequency band width (Δf) to the frequency (fo).

Figure 4:
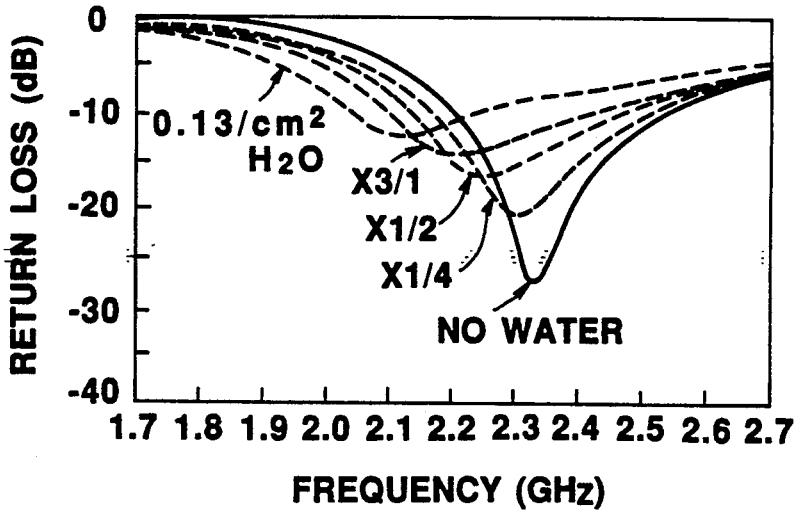
FIG. 4 is a graph used in explaining the effect of precipitation on the antenna frequency characteristic.

FIG. 4 is a graph plotting return loss with respect to given frequencies for different amounts of waterdrops deposited on the patch antenna. The solid curve relates to no waterdrop deposited on the plane patch antenna. As can be seen from a study of FIG. 4, the available frequency band shifts to a greater extent toward the low frequency side as the amount of waterdrop deposited on the plane patch antenna increases.

Figure 5:
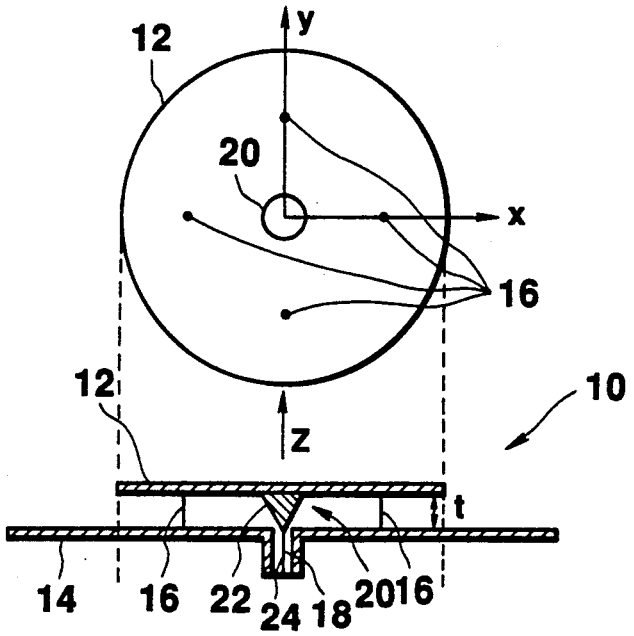
FIG. 5 is a sectional view showing one embodiment of a plane patch antenna made in accordance with the invention.

Referring to FIG. 5, there is shown a plane patch antenna embodying the invention. The plane patch antenna, generally designated by the numeral 10, includes disc-shaped patch and earth plate members 12 and 14 maintained rigidly in coaxial and spaced-parallel relation to each other by a plurality of (in the illustrated case four) circumferentially-spaced short pins 16 secured thereto. The character (t) indicates the distance between the patch and earth plate members 12 and 14. The patch and earth plate members 12 and 14. The patch and earth plate members 12 and 14 are made of a conductive material. Alternatively, each of the patch and earth plate members 12 and 14 may be taken in the form of a conductive metal film disposed on one of the opposite surfaces of a disc-shaped synthetic resin plate member. The earth plate member 14 has a diameter greater than that of the patch plate member 12. The short pins 16 are conductive pins for providing an electrical connection between the plate members 12 and 14.

A feeder shaft 20 extends from the center O of the patch plate member 12 through a through-hole 18 centrally formed in the earth plate member 14 for connection to a read wire. The feeder shaft 20 is insulated electrically from the earth plate member 14. The feeder shaft 20 has a tapered portion 22 extending from the the patch plate member 12 toward the earth plate member 14. The tapered portion 22 has a cross-sectional area which has a maximum value at its bottom and a minimum value at its top. The tapered portion 22 may be of a cone shape, a pyramid shape, or other shapes having a cross-sectional area decreasing in a stepped or stepless fashion as going away from the bottom. The tapered portion 22 may be made of copper, aluminum, or other conductive materials. The tapered portion 22 may be formed by a conductive metal film disposed on the outer surface of a synthetic resin taper. The bottom of the tapered portion 22 is coaxially secured to the patch plate member 12. The top of the tapered member 20 is connected to a shaft member 24 which forms a part of the feeder shaft 20. The shaft member 24 may taken in the form of a coaxial cable having center threads covered by a braided sheath. The braided sheath is connected to the earth plate member 14 and the center threads are connected to a transmitter/receiver unit associated the the plate patch antenna 10.

Figure 6A:
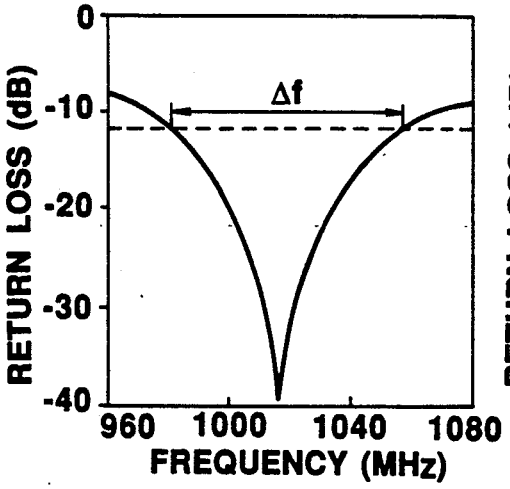
FIGS. 6A and 6B are graphs used in comparing the available frequency band width obtained by the plane patch antenna with the available frequency band width provided by the prior art plane patch antenna.
Figure 6B:
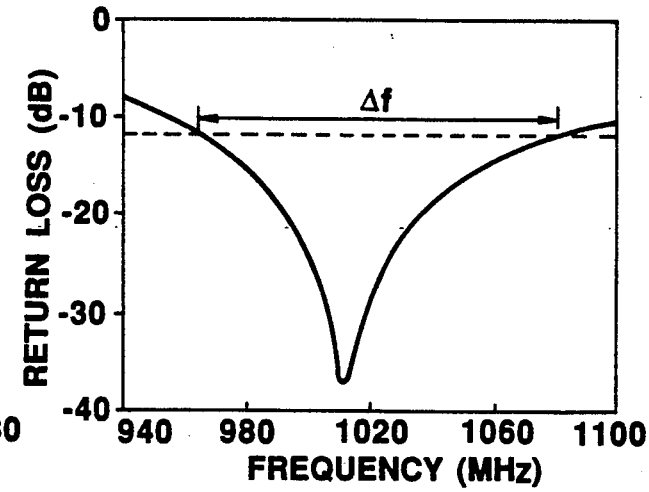

A test was conducted to show the effect of the the plane patch antenna of the invention on the frequency band width. Test results are shown in FIGS. 6A and 6B. FIG. 6A is a graph showing frequency versus return loss provided by the prior art plane patch antenna of FIG. 1 where the patch plate member A has a diameter of 0.5λ and is spaced at a distance (t) of 0.03λ (10 mm) from the earth plate member B. It was found from the test results that the prior art plane patch antenna had a fraction band width of 7.4% at a return loss of −11.7 dB. FIG. 6B is a graph showing frequency versus return loss provided by the plane patch antenna of the invention where the patch plate member 12 has a diameter of 0.5 and is spaced at a distance (t) of 0.3λ (10 mm) and where the tapered portion 22 of the feeder shaft 20 has a maximum diameter of 0.17λ. It was found from the test results that the plane patch antenna of the invention had a fraction band width of 11.8% at a return loss of −11.7 dB. As can be seen from a comparison of these test results, it is apparent that the plane patch antenna of the invention has an available frequency band width much wider than that of the prior art plane patch antenna of FIG. 1.

Figure 7A:
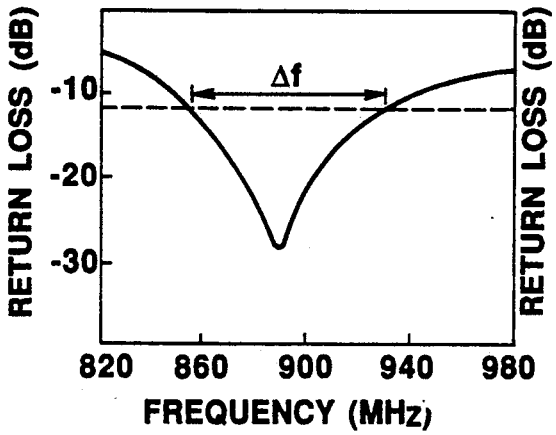
FIGS. 7A and 7B are graphs used in comparing the available frequency band width obtained by the plane patch antenna with the available frequency band width provided by the prior art plane patch antenna.
Figure 7B:
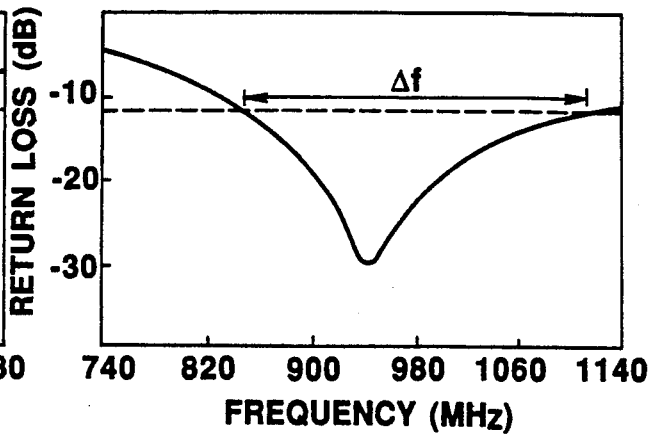

Another test was conducted to show the effect of the plane patch antenna of the invention on the available frequency band width. The test results are shown in FIGS. 7A and 7B. FIG. 7A is a graph showing frequency versus return loss provided by the prior art plane patch antenna of FIG. 1 where the patch plate member A is spaced at a distance 0.035λ (12 mm) from the earth plate member B. It was found that the prior art plane patch antenna has a fraction band width of 8.2% at a return loss of −11.7 dB. FIG. 7B is a graph showing frequency versus return loss provided by the plane patch antenna of the invention where patch plate member 12 is spaced at a distance of 0.035λ (12 mm) from the earth plate member 14 and the tapered portion 22 has a maximum diameter of 0.16λ. It was found that the plane patch antenna of the invention has a fraction band width of 18.4% at a return loss of −11.7 dB. It can be seen from a comparison of these test results that the plane patch antenna of the invention has a much wider available frequency band width than the prior art plane patch antenna. It can also be seen from a comparison between the graphs of FIGS. 6B and 7B that the fraction band width can be further increased by an appropriate choice of the distance (t) between the patch and earth plate members 12 and 14.

Figure 8:
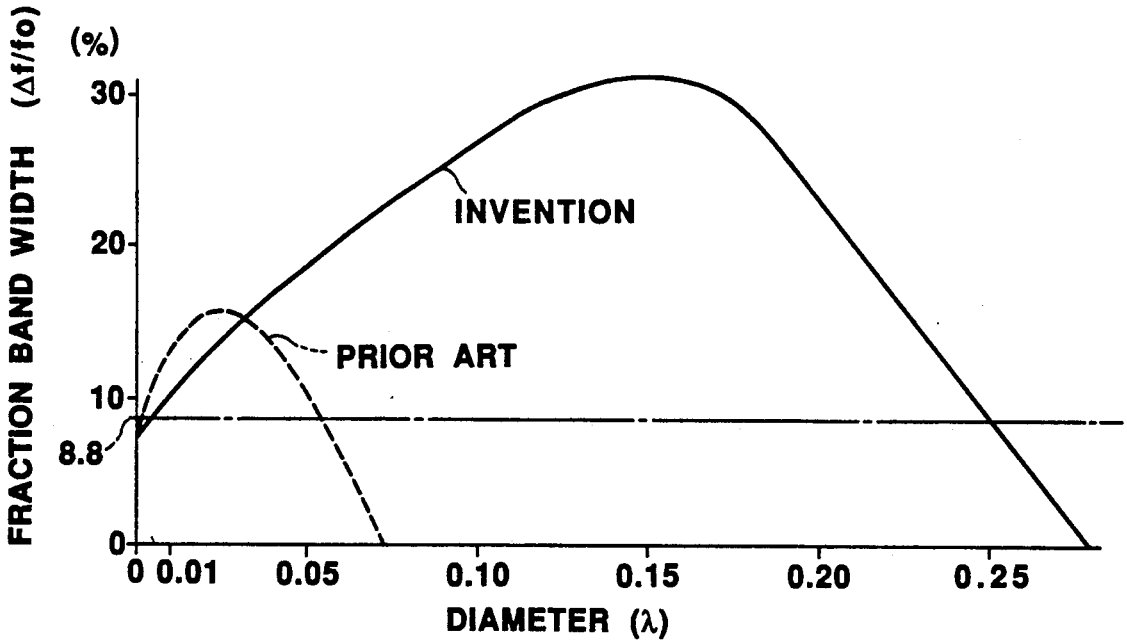
FIG. 8 is a graph used in explaining the influence of the diameter of the feeder shaft on the fraction band width of the plane patch antenna.

FIG. 8 is a graph plotting fraction band width (Δf/fo) with respect to given diameters of the maximum cross-sectional area of the feeder shaft at a return loss of −11.7 dB where the patch plate member has a diameter ranging from 0.45 to 0.57λ and is spaced from the earth plate member at a distance ranging from 0.03 to 0.05λ. The solid curve relates to the plane patch antenna of the invention where the fraction band width is plotted with respect to given diameters of the maximum cross-sectional area of the tapered portion 22 of the feeder shaft 20. The broken curve relates to the prior art plate patch antenna where fraction band width is plotted with respect to given diameters of the feeder shaft D. It is apparent from FIG. 8 that the invention can increase the available frequency band width to a remarkable extent as compared to the prior art plane patch antenna. It is to be noted that the maximum fraction band width is obtained when the maximum diameter of the tapered member is in a range of 0.12 to 0.18λ. If it is larger or smaller than this range, the fraction band width decreases.

Figure 9:
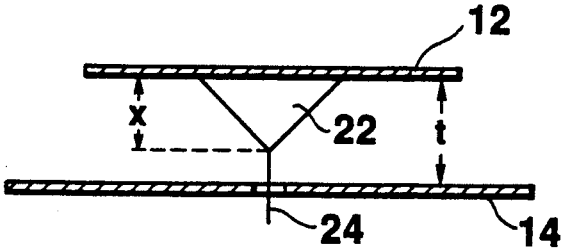
FIG. 9 is an enlarged fragmentary sectional view of the plane patch antenna of the invention.

FIG. 9 shows a relation between the distance (t) at which the patch plate member 12 is spaced from the earth plate member 14 and the height or length (x) of the tapered portion 22 of the feeder shaft 20. Although a maximum fraction band width can be obtained when the length (x) is equal to the distance (t), it is to be noted that a sufficient fraction band width can be obtained when the length (x) is equal to or greater than one-fourth of the distance (t).

Figure 10A:
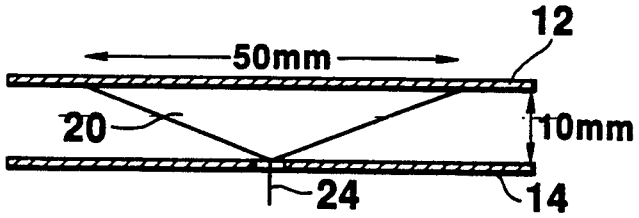
FIGS. 10A to 10D are enlarged fragmentary sectional views showing different feeder portion sizes.
Figure 10B:
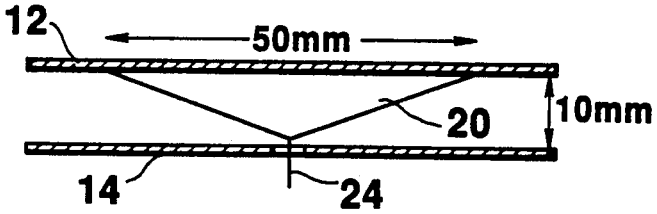
Figure 10C:
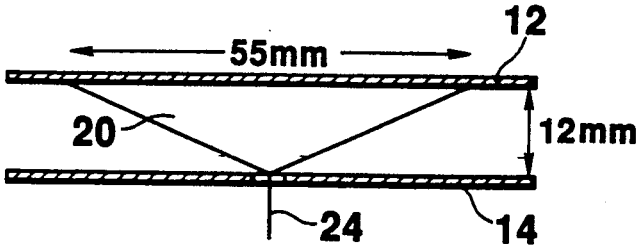
Figure 10D:
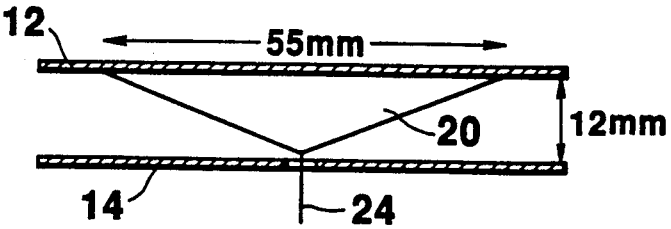

No substantial difference exists between the available frequency band widths obtained by a plane patch antenna including a copper tapered portion 22 having a maximum diameter of 50 mm and a length of 10 mm, as shown in FIG. 10A, and a plane patch antenna including a copper tapered portion 22 having a maximum diameter of 50 mm and a length of 9 mm, as shown in FIG. 10B. The plane patch antennas of FIGS. 10A and 10B have the same antenna height (t) of 10 mm. In addition, no substantial difference exists between the available frequency band widths obtained by a plane patch antenna including a copper tapered portion 22 having a maximum diameter of 55 mm and a length of 12 mm, as shown in FIG. 10C, and a plane patch antenna including an aluminum tapered portion 22 having a maximum diameter of 55 mm and a length of 11 mm. The plane patch antennas of FIGS. 10C and 10D have the same antenna height (t) of 12 mm.

It is, therefore, apparent from the foregoing that the invention provides an improved plane patch antenna having an increased available frequency band width. The plane patch antenna of the invention can be used in the rain with its most efficiency even when the antenna manufacturing and mounting tolerances are not critical. This is achieved by a feeder shaft provided with a tapered portion extending from the patch plate member toward the earth plate member, the tapered portion having a cross-sectional area decreasing as going away from the patch plate member. The reasons why the tapered portion can increase the available frequency band width of the plane patch antenna are not fully understood, but some general observations may be made. The tapered portion of the feeder shaft has a cross-sectional area which is at maximum in the area of attachment to the patch plate member and decreasing as going away from the patch plate member. This structure provides a smooth mechanical continuation between the patch plate member and the coaxial cable center threads which forms a part of the feeder shaft, thereby improving the matching between the patch plate member and the feeder shaft.

What is claimed is:

1. A plane patch antenna comprising:

a patch conductive plate member;

an earth conductive plate member;

a plurality of short pins extending between the patch and earth plane members to maintain the patch and earth plate members in spaced-parallel relation to each other and to make electric connection between the patch and earth plate members; and a feeder shaft extending from the patch plate member for electrical connection of the patch plate member to a lead wire, the feeder shaft having a tapered portion extending from the patch plate member toward the earth plate member, the tapered portion having a cross-sectional area decreasing as going away from the patch plate member, the tapered portion having a maximum diameter in its area of attachment to the patch plate member, the maximum diameter being in a range of 0.12λ to 0.18λ.

2. The plane patch antenna as claimed in claim 1, wherein the tapered portion is of a cone shape having a maximum diameter in its area of attachment to the patch plate member.

3. The plane patch antenna as claimed in claim 2, wherein the maximum diameter of the tapered portion is in a range of 0.12λ to 0.18λ.

4. The plane patch antenna as claimed in claim 3, wherein the patch plate member has a diameter ranging from 0.45λ to 0.57λ.

5. The plane patch antenna as claimed in claim 4, wherein the tapered portion has a length equal to or greater than one-forth of the distance between the patch and earth plate members.

6. The plane patch antenna as claimed in claim 5, wherein the earth plate member is spaced at a distance greater than 0.03λ from the patch plate member.

* * * * *